US005640459A

United States Patent [19]

Hedeen

[11] Patent Number: 5,640,459

[45] Date of Patent: Jun. 17, 1997

[54] PORTABLE VOICE AMPLIFIER

[76] Inventor: Edwin E. Hedeen, 14360 Wooded Path La., Orland Park, Ill. 60462

[21] Appl. No.: 520,500

[22] Filed: Aug. 29, 1995

[51] Int. Cl.[6] ..... H04R 27/04

[52] U.S. Cl. ..... 381/75; 379/433; 455/351

[58] Field of Search ..... 381/75, 77, 82, 381/91, 87; 379/433, 434, 428; 455/350, 351, 89, 90

[56] References Cited

U.S. PATENT DOCUMENTS

| | | | |
|---|---|---|---|
| D. 168,578 | 1/1953 | Levison . | |
| D. 216,018 | 11/1969 | Sieler . | |
| D. 231,236 | 4/1974 | Cresap . | |
| D. 247,966 | 5/1978 | Sieler . | |
| D. 271,968 | 12/1983 | Segan . | |
| D. 291,199 | 8/1987 | Knoedler . | |
| D. 301,146 | 5/1989 | Watamabe . | |
| D. 326,653 | 6/1992 | Hino . | |
| D. 328,621 | 8/1992 | Kabayashi . | |
| D. 332,608 | 1/1993 | Masagaki . | |
| D. 337,590 | 7/1993 | Satoh . | |
| D. 338,204 | 8/1993 | Takao . | |
| D. 347,439 | 5/1994 | Kackwicz . | |
| D. 347,634 | 6/1994 | Jobo . | |
| 2,218,389 | 10/1940 | Warmbier . | |
| 2,692,913 | 10/1954 | Kamimori . | |
| 2,830,116 | 4/1958 | Hardesty . | |
| 2,915,587 | 12/1959 | Hardesty . | |
| 3,029,307 | 4/1962 | Baxt . | |
| 3,042,749 | 7/1962 | Johnson . | |
| 4,076,957 | 2/1978 | Molay . | |
| 4,237,341 | 12/1980 | Richards . | |
| 4,325,142 | 4/1982 | Nakazawa | 455/351 |
| 4,400,591 | 8/1983 | Jennings . | |
| 4,773,091 | 9/1988 | Busche . | |
| 4,969,206 | 11/1990 | Desrochers | 455/351 |
| 5,208,717 | 5/1993 | Takao . | |
| 5,210,532 | 5/1993 | Knoedler . | |
| 5,251,329 | 10/1993 | Takagi et al. | 379/440 |
| 5,307,401 | 4/1994 | Matsuda | 379/440 |
| 5,450,618 | 9/1995 | Naddell et al. | 455/89 |
| 5,577,269 | 11/1996 | Ludewig | 455/90 |

*Primary Examiner*—Curtis Kuntz
*Assistant Examiner*—Ping W. Lee
*Attorney, Agent, or Firm*—Emrich & Dithmar

[57] ABSTRACT

A portable voice amplifier includes a casing providing a housing and including a flat base, a curved front wall extending from the base upwardly and over the base, when viewed from the side, to the top of the unit. A speaker is mounted in the lower portion of the curved front wall, and the casing includes a lower section partially formed by the lower portion of the curved front wall and having a progressively narrow depth preceding from the base to approximately the midsection of the casing. An upper section of the housing has generally uniform depth and width from the midsection to the top of the unit. The upper section is designed to be held conveniently by the hand of the user, with a microphone located on the rear of the upper housing section so that in normal use the entire unit extends below the face of the user and is conveniently and comfortably held with a single hand. The unit includes a time-of-day clock and elapsed timer, with all of the controls located adjacent the hand of the user when it is held in a normal position. A lanyard may be used to secure the unit around the neck of the user to free the user's hands for demonstrations, hand gestures or writing on a board during a presentation. The unit is designed for clear audio speech delivery for smaller audiences and for medium sized rooms.

8 Claims, 5 Drawing Sheets

PORTABLE VOICE AMPLIFIER

FIELD OF THE INVENTION

The present invention relates to voice amplifiers; and more particularly, to self-contained, portable electronic voice amplifiers.

BACKGROUND OF THE INVENTION

Voice amplifiers, such as conventional megaphones used for crowd control or the like, are known. Commercially available megaphones are not suitable for presentations to smaller groups because they must be placed directly in front of the mouth of the speaker, thereby obscuring a view of the speaker's face, for proper use. Moreover, megaphones and the like have a designed audio volume so that they can be heard over substantial distances and in spite of loud ambient noise. The quality of the transmission is generally not of great importance. The volume, however, is considered important.

Voice amplifiers such as megaphones and so-called "karaokes", even though portable, are usually not suitable for use under more controlled settings, such as business meetings, sales presentations, educational dissertations, and seminars and training meetings. It is these latter applications to which the present invention is directed. Some suggestions have been made for portable voice amplifiers for these applications, but for the most part, they have failed to take into account the ergonomic or human aspects of using the unit under various conditions. Nor are existing units attractive to the user, yet economical to manufacture. Another problem even with more affordable voice amplifiers is that they are bulky and inconvenient to transport in a carrying bag or briefcase which a business person might use.

SUMMARY OF THE INVENTION

The present invention is directed to a personal portable, hand-held electronic voice amplifier unit which overcomes the problems of inconvenience and bulkiness of megaphones and public address (PA) systems. The invention utilizes a smaller stylized unit easily carried in a briefcase or carry bag yet it provides quality voice amplification for small group meetings such as in lecture rooms, shop or office training in a factory, as well as for athletic training and field events, tours, family outings, camping and hiking to mention a few.

The present invention achieves the primary objectives of providing appropriate voice amplification for small groups, through a lightweight, multi-purpose system housed in an attractive, ergonomic convenient casing; and combines the physical, electronic and aesthetic aspects of a voice amplifier in a casing which houses the functional elements, all in an affordable unit.

The casing has a flat base and a curved front wall which faces the audience in use. The front wall curves upwardly from the front of the base in a uniform arc so that it extends above the base. A rear wall extends from the rear of the base upwardly and forwardly, converging with the curved forward wall, up to a location approximately midway of the height of the unit. The lower section of the forward wall and the lower section of the rear wall cooperate, together with the base and the side walls to form a housing for the speaker. Thus, the speaker transmits from the lower portion of the curved front wall. The upper section of the housing has a general uniform depth and width but continues the curvature of the forward wall. Thus, the upper section of the rear wall is generally parallel with the upper section of the forward wall to form a handle or grip conveniently held by one hand with the thumb on the rear wall and the four fingers engaging the upper portion of the forward wall, the center of gravity of the unit being below the hand hold of the unit, rather than above it, as in stage microphones.

A small microphone is located in the upper portion of the rear wall adjacent the top so that when the unit is held in the hand and the microphone is placed adjacent and slightly below the mouth of the user, the user's face is completely unobstructed so that he or she can maintain eye contact with the audience and be readily visible for facial expressions that may be generated during the presentation.

A lanyard is attached to the unit so that the user may place the unit on his chest, held by the lanyard around his neck in an out-of-use position. The user's hands are thus completely free for demonstrations, writing or the like. The flat base, and the conformation of the front and rear walls of the casing permit the unit to be set on a surface in an upright position and in a very stable mode because the center of gravity lies within the periphery of the base. On the other hand, because of the recessed outline of the rear wall, with all controls being protected by the upper and lower edges of the rear wall, the unit may be placed on its back or side for a lower profile. Thus, it can be conveniently carried in a briefcase or the like.

A display is contained in the upper portion of the rear wall adjacent to the microphone for convenient and accessible viewing by the user. A time-of-day clock and elapsed timer may be provided in the unit with a display mounted in an opening adjacent the microphone.

Provisions are made inside the casing for mounting the microphone and for isolating it, from the housing. Further, the shape of the housing and the positioning of the microphone and the speaker on opposite faces and opposite ends of the unit reduces acoustical feedback. Acoustical feedback from the speaker to the microphone is also reduced by a housing the speaker in an acoustical "pocket", together with a rubber grommet mounting system, to isolate the speaker from the casing forming the housing.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
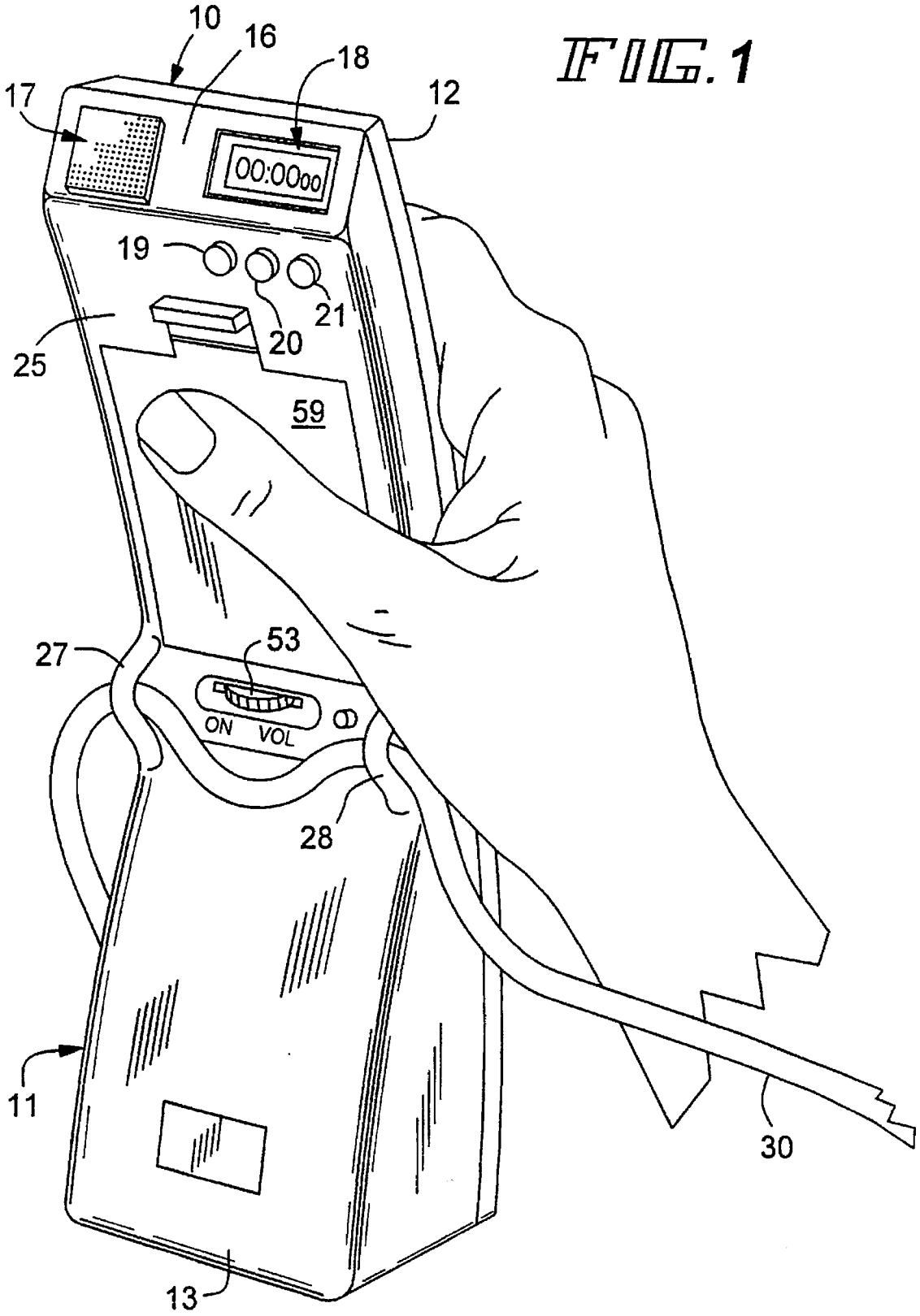
FIG. 1 is an upper, right rear perspective of a portable voice amplifier constructed according to the invention illustrating how it is held in one hand under normal use, with the microphone and digital timer display readily accessible to the user.
Figure 2:
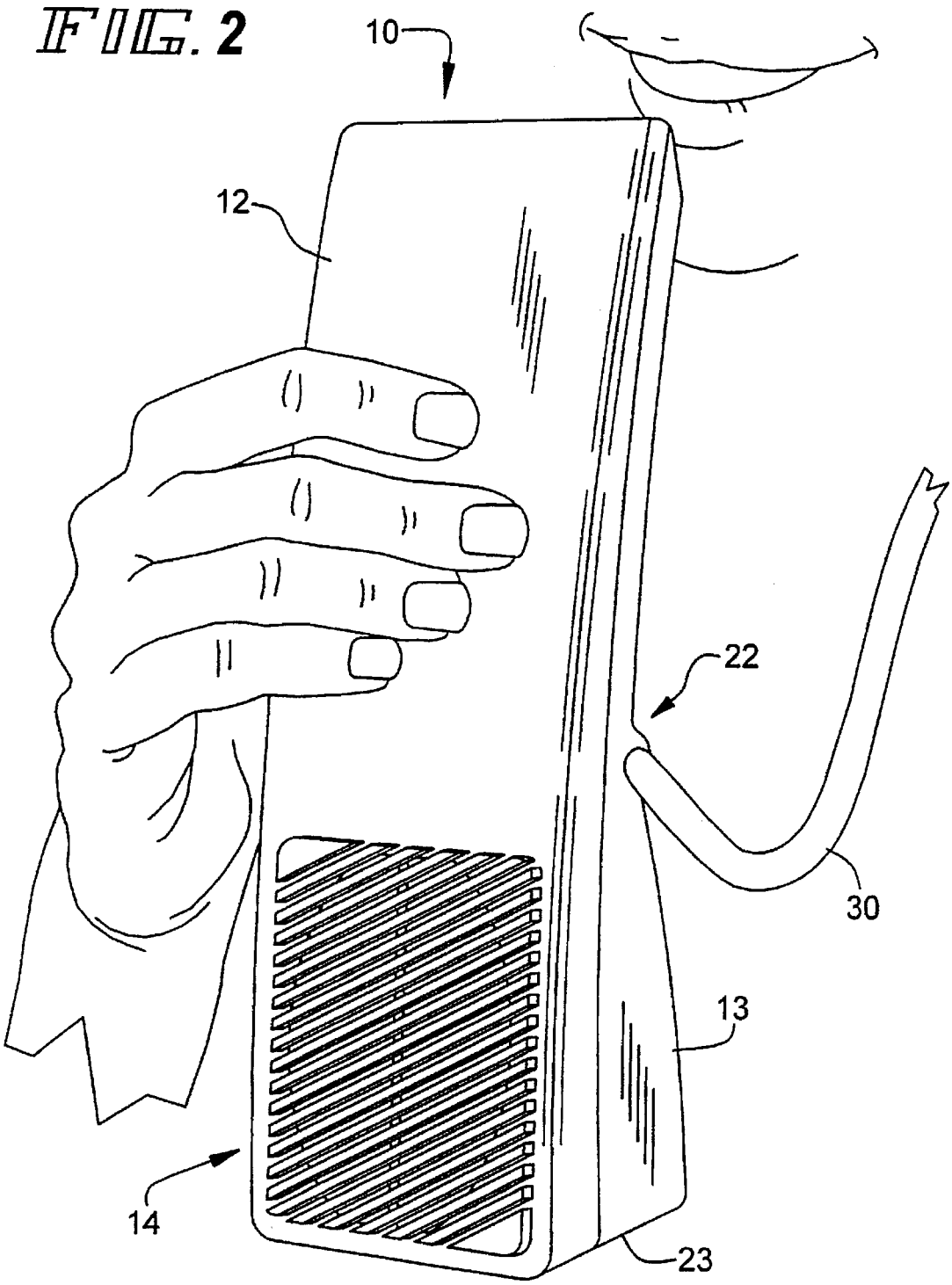
FIG. 2 is an upper, left frontal prospective view of the portable voice amplifier shown in FIG. 1, again illustrating the convenience with which it is used.

Turning first to FIGS. 1 and 2, reference 10 generally designates the portable electronic voice amplifier of the present invention. The unit 10 includes an outer casing or housing generally designated 11 which includes mating front and rear sections designated respectively 12 and 13. The front and rear casing sections are mated together and secured, as will be described further below.

In the lower portion of the front casing section 12, as seen best in FIG. 2, a grill 14 is integrally formed by parallel strips spaced apart and inclined, as seen in the drawing, for permitting the audio to be transmitted from a speaker mounted behind the grill 14, again in a manner to be described.

As best seen in FIG. 1, the upper portion of the rear casing section 13 is formed into an inclined wall 16 to which are mounted a microphone in the location generally designated 17, and a display at 18. The display 18 is a digital display for a digital time-of-day clock and elapsed time timer (sometimes referred to as a "clock/timer" for brevity), to be described further, and it will be observed that three control buttons 19, 20 and 21 are mounted on the rear surface 25 of the upper portion of the rear casing 13, right below the display area 18, but readily accessible to the user.

It will be helpful to understand the overall ergonomic and functional aspects of the voice amplifier unit 10 before returning to the details. As seen in FIG. 1, the front and rear casing sections are shaped such that the unit, as a whole, includes a lower section which extends from a generally flat base or bottom wall 23 to a midsection generally designated by reference 22 in FIG. 2. The front and rear walls of the housing converge progressively from the base 23 to the midsection 22. Above the midsection 22, the front and rear walls of the housing are curved and generally parallel to provide a substantially constant depth and width to the unit. The upper section extends upwardly to a location at the bottom of the inclined wall 16 described above.

The front wall of the front casing section 12 has a generally continuous and uniform curvature from the base to top so that it presents, to an observer facing the user, an attractive, uniform styling. Yet, the controls, display and microphone are readily accessible to the user from the rear as illustrated in FIG. 1. More importantly, however, as can be seen from a study of both FIGS. 1 and 2, the upper section of the unit housing is designed to form a grip to fit comfortably within the hand of the user so that the user can place four fingers on the front wall of the front casing section 12 with the thumb on the rear wall 25 of the upper section of the casing. This makes it convenient for the user to "locate" the microphone 17 adjacent his or her mouth during use without obscuring the user's vision or hiding the user's face from the audience. In the case where time of presentation is important, the controls are immediately accessible to the hand of the user, and the display of elapsed presentation time or current time of day.

Moreover, the rear casing section 13 has formed in it adjacent the midsection 22, left and right loops 27, 28, through which a lanyard 30 may be strung and formed into a means for suspending the voice amplifier around the neck of the user when the user either wants to point to a display or to use his or her hands to demonstrate a point or some physical object. With the structure illustrated, moreover, the center of gravity of the unit (which is not heavy, and ideally weighs in the neighborhood of 9–10 ounces) is below the hand holding the unit so that it does not have a top-heavy feel to the user, as some stage microphones do.

Figure 3:
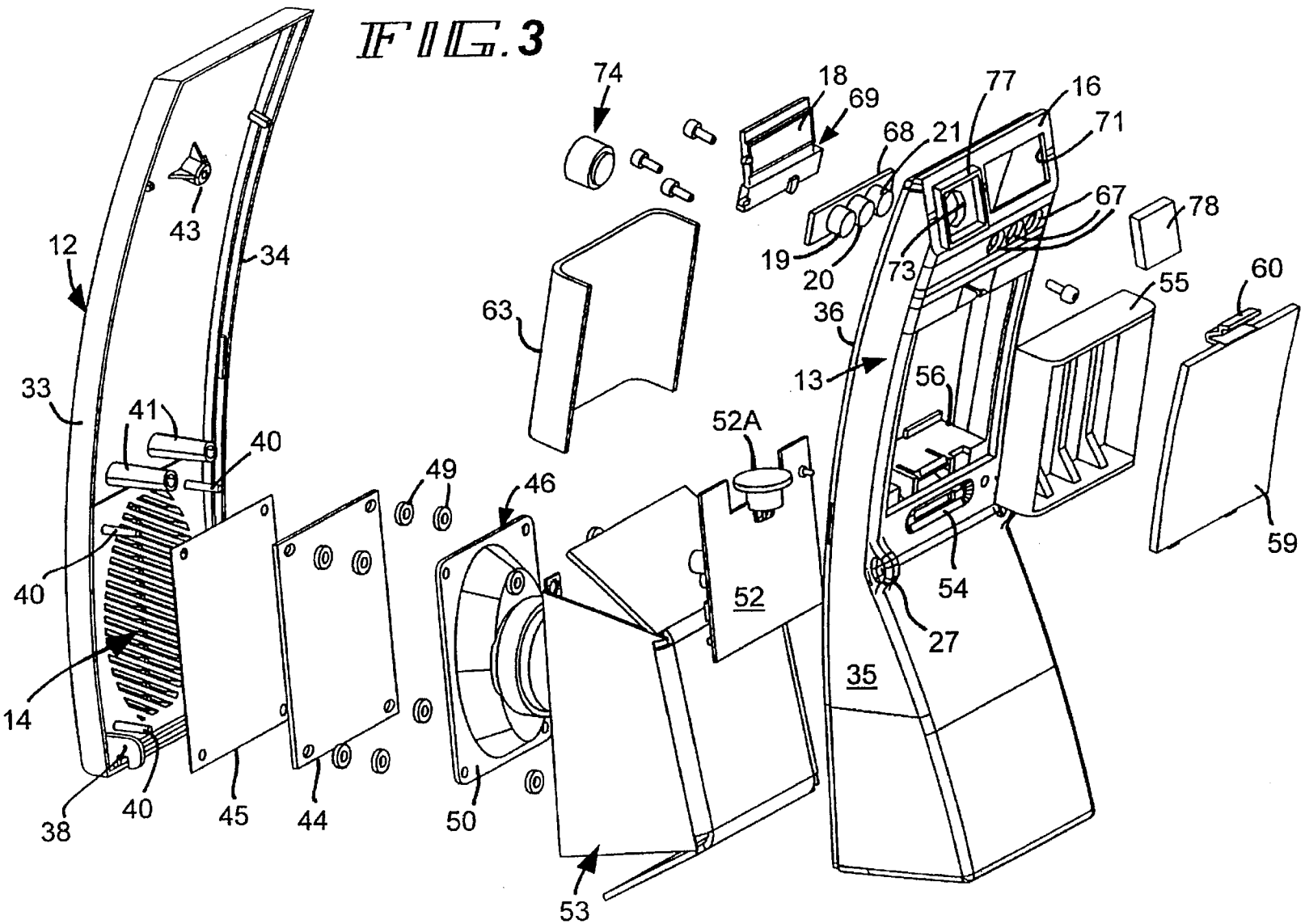
FIG. 3 is an upper, left rear perspective view of the voice amplifier showing the major components thereof in exploded relation.
Figure 4:
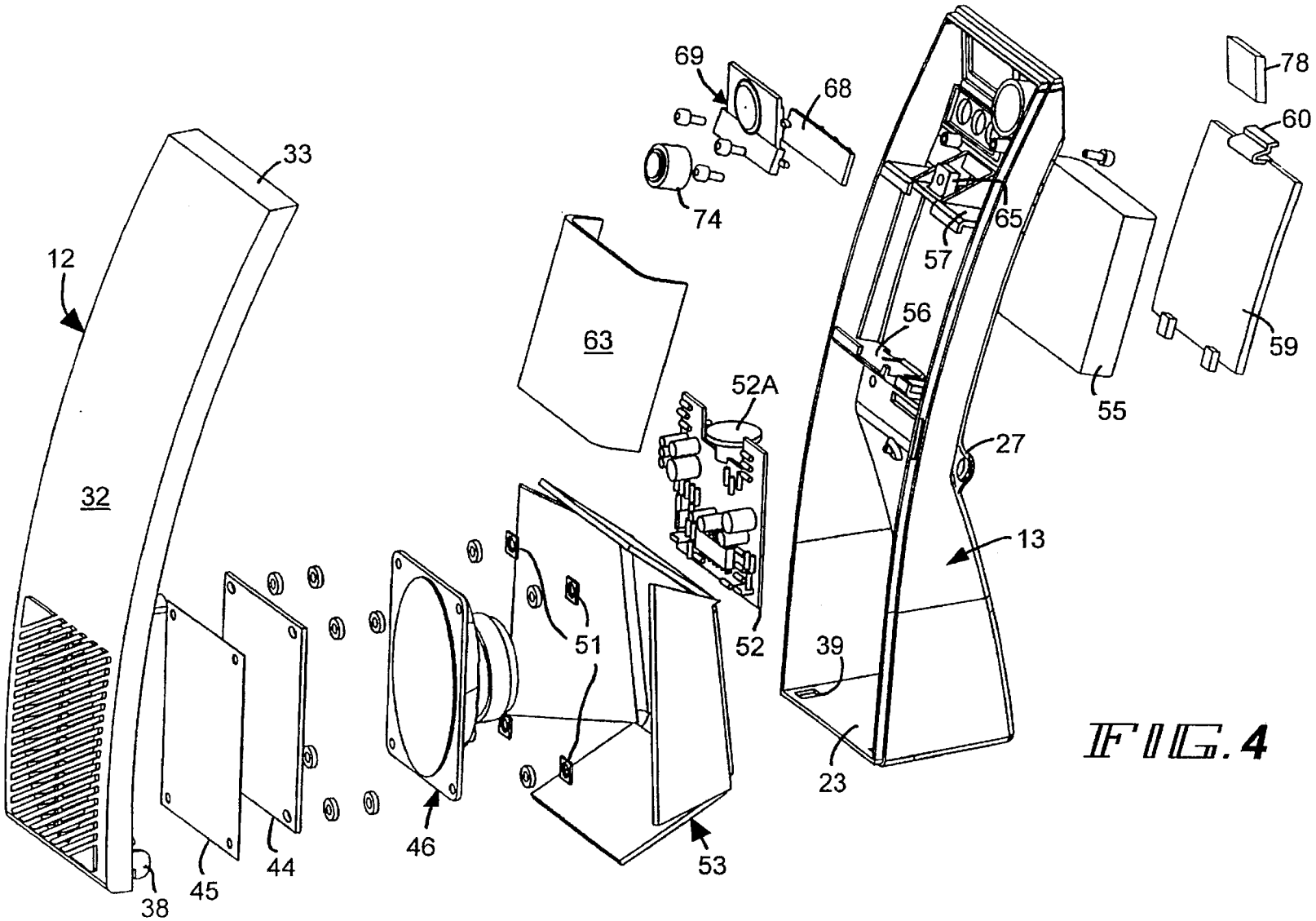
FIG. 4 is an upper, left frontal perspective of the voice amplifier, again with the major components and exploded relation.

Turning now to FIGS. 3 and 4, the front casing section in the illustrated embodiment is an integrally molded plastic assembly comprising a curved front wall 32 of generally uniform width and height and smoothly and continuously curved from the bottom to the top. It also includes a rear-wardly-extending peripheral side wall 33 having a distal edge 34 of reduced thickness to receive and mate with the forward edge of the rear casing section 13. The rear casing section has a similar peripheral side wall 35 at the forward edge of which there is a rim 36 which nests inside and mates with the inner surface of the distal edge 34 of the front casing section 12 to seal the unit against external acoustical feedback.

Returning to the structure of the front casing section 12, it includes a pair of lower hooks 38, one of which is seen in FIG. 3, for coupling to mating recesses formed in the bottom wall 20 of the rear casing section 13, one of the recesses being designated 39 in FIG. 4.

Still referring the front casing section 12, the grill 14 can be seen at the bottom; and about the grill 14 are placed four locating posts 40. Above the posts 40 there is a pair of projections 41 which, as will be described, are used to secure a printed circuit board carrying the electronic amplifying components. Also projecting from the rear surface from the front wall 32 Of the front casing section is a boss 43 which, as will be described, receives a screw securing the two casing sections together.

Mounted behind the grill 14 and received on the posts 40 is a scrim 45. The scrim 45 is a section of cambric cotton cloth which forms a barrier and protective cover for the speaker 46 mounted behind it. A felt acoustical dampening screen 44 is mounted on the posts 40 behind the scrim 45 for enhancing the quality of sound from speaker 46. The speaker is also received on the posts 40. The screen 44 provides isolation and dampening for the acoustical output of the speaker 46. The speaker 46 is further isolated by rubber grommets 49 received on the posts 40 both in front of and behind the mounting flange 50 for the speaker 46. The speaker is then secured by fasteners 51 on the posts 40.

The rear section of the speaker 46 is received in a partial housing referred to an acoustical pocket and designated 53 in FIG. 3. It is formed of standard industrial foam familiar to those in the art. It is a 100 ppi reticulated urethane foam commercially available. The pocket 53 isolates the rear portion of the lower section of the housing from the acoustical energy transmitted by the speaker 46. It is deemed important that there be no mechanical vibrations transmitted through the housing structure from the speaker back to the microphone which could possibly cause undesired oscillation in the electronic amplifier circuitry.

As seen in both FIGS. 3 and 4, a printed circuit board 52 is mounted to the projections 41 extending from the rear of the front casing section 32. The printed circuit board 52 carries the electronic components of the amplifier, and it includes a thumb wheel 52A of a variable resistor for controlling the gain of the amplifier in a conventional manner. The thumb wheel 52A rotates about an upright axis and fits through a slot 54 (FIG. 3) in the rear surface of the rear casing section 13, adjacent the midsection of the housing.

In the lower portion of the upper section of the housing, there is a battery compartment 55 for holding four AAA-size batteries. The battery compartment is secured between a lower shelf 56 (FIG. 3) and an upper shelf 57 (FIG. 4). An opening 61 is formed in the rear surface of the rear housing section 13 for receiving a cover 59 with a latch 60 which is releasably secured to the housing 13 at the top of the opening 61.

A sheet of urethane foam 63 is placed around the front and sides of the battery housing 55 in the final assembly to fill the space between the compartment 55 and the front and side walls of the front and rear casing sections 12, 13. By filling the space with standard industrial foam in this manner, further acoustical isolation is provided between the speaker in the lower section of the housing and the microphone in the upper rear section of the housing. This further improves acoustical isolation between the two.

As best seen in FIG. 4, the upper ledge 57 which receives the battery compartment 55 has integrally molded in it, an apertured lug 65 for receiving a screw which is threaded into the boss 43 (FIG. 3) formed on the rear surface of the upper portion of the front casing section 12 to secure the two casing sections together.

Turning now particularly to FIG. 3, above the opening 61 for the battery compartment, three apertures 67 are formed in the rear surface of the rear casing section 13. The apertures 67 receive the three push actuators 19, 20, 21 of a button board 68 mounted behind the apertures 67. The button board 68 cooperates with the circuitry of a conventional clock/timer generally designated 69 which includes the previously mentioned digital display 18. The display 18 is received in an opening 71 above the opening 67, in the upper rear portion of the rear casing section 13, except, as will be recalled, the opening 71 for the display is in the slanted or inclined wall section 16, as better seen perhaps in FIG. 1.

To the left of the display opening 71 there is formed an aperture 73 for receiving a microphone designated 74 in FIG. 3.

A frame or ridge 77 is formed in the rear casing section surrounding the microphone opening 73 for receiving a urethane cover (or "pop" screen) 78 for the microphone.

Returning now to FIGS. 1 and 2, it can be appreciated that the convenience and compactness of the location of the display 18 and microphone assembly 17 on the inclined surface 16 in the upper rear portion of the rear casing section 13 provide a convenient accessibility to the user. The control buttons 19, 20 and 21 for the clock/timer are equally accessible. The control buttons are used to set the current time and initiate the elapsed timer or count-down mode, in the digital clock/timer having a digital display 18.

Moreover, the aesthetics of the unit from a frontal appearance (FIG. 2) maintain since the battery cover 59 is in the rear. The adjustment of the amplitude by means of the thumb wheel 53 is also readily accessible during use to the user.

The flat bottom wall 23 of the housing enables the user to place the unit on a flat surface such as a table or podium when not in use. If the unit is to be stored or requires further security, it may be set down horizontally—that is, one end resting on a table or the like by means of the inclined surface 16, and the rear edge of the bottom wall forming the other support on the flat surface. This protects all of the control and display components from possible damage.

The shape of the housing is primarily aesthetic. However, there are three functional advantages to the shape of the housing and placement of the components within the housing. The first is that the curvature of the front wall of the front casing section 12 and the conformation of the front and rear walls of the front and rear casings respectively forming the upper section of the housing cooperates with the lower section of the housing such that the center of gravity of the unit is located above the bottom wall 23. This provides a stability when the unit is set down for rest on the bottom wall. Moreover, the general shape of the lower housing section which provides a bottom wall of greater depth for stability yet which narrows progressively upwardly toward the midsection 22 permits the speaker assembly to be mounted lower in the unit, and this, in turn, provides a desirable "feel" to the unit in use, particularly when being held by one hand. That is, the weight of the unit is primarily beneath the hand, rather than above it which would provide a "top-heavy" feel. Third, the location of the speaker in the lower, forward portion of the front surface and the corresponding location of the microphone on the upper rear section of the housing provides acoustical isolation which is desirable in reducing any tendency for electrical oscillation in the amplifier.

Figure 5:
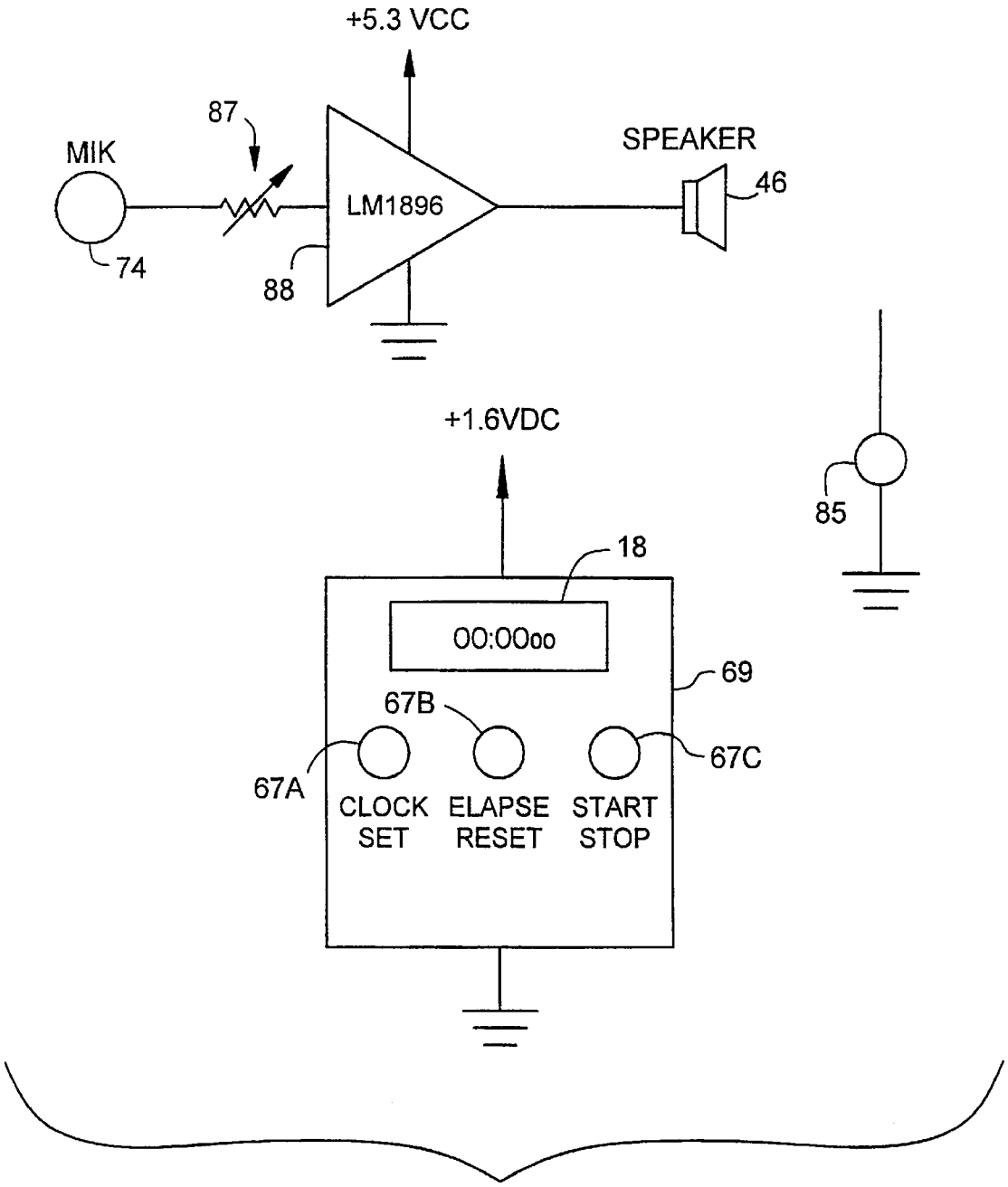
FIG. 5 is an electrical circuit schematic of the electronic components of the voice amplifier of FIG. 1.

Turning now to FIG. 5, there is shown an electrical schematic of the circuitry, all of which is conventional.

A light-emitting diode (LED) 85 is energized when the unit is turned on to signal to the user that the power is on.

The microphone 74 is connected in series circuit with a variable resistor 87 controlled by the thumb wheel 54, previously described to the input of a conventional voice frequency amplifier 88. The voice frequency amplifier may be a commercially available integrated circuit LM1896 manufactured by National Semiconductor of Santa Clara, Calif. The output of the amplifier 88 feeds the speaker 46. The time-of-day clock and elapsed timer 69 is also a conventional circuit widely available. The illustrated unit includes the digital display 18, and the three control buttons designated 19, 20 and 21 in FIGS. 1, 3 and 5 which control respectively the clock setting, elapse time reset and start/stop.

Other features and advantage of the present invention will be apparent to persons skilled in the art from the following detailed description of a preferred embodiment accompanied by the attached drawing wherein identical reference numerals are referred alike portion in the various views.

I claim:

1. A portable, hand-held electronic voice amplifier unit comprising:

a casing having a flat base, a uniformly curved front wall extending upwardly and slightly rearwardly of the front edge of said base, a lower section including a lower portion of said curved front wall and having a narrow depth proceeding above said base to a midsection, and an upper section having a generally uniform depth from said midsection to the top of said casing, the height and the peripheral distance about said upper section being such that a user's hand may comfortably grasp and hold said unit in use;

a speaker mounted in the lower portion of said front wall and housed within said lower section of said casing;

a microphone mounted to a rear surface of said upper section of said housing adjacent the top thereof;

battery means mounted in said casing for supplying electrical power;

an amplifier for receiving signals from said microphone and amplifying said signals and driving said speaker; and a sound trap filling any void in a portion of said upper section below said microphone and above said speaker for isolating sound and vibration transmission between the two within said casing.

2. The apparatus of claim 1 further comprising an acoustical pocket in the lower section of said housing and enclosing the rear and sides of said speaker for providing acoustical isolation between said speaker and said housing.

3. The apparatus of claim 2 further including means for mounting said speaker to the lower portion of said front wall of said casing including a plurality of mounting posts extending rearwardly from said front casing wall; front rubber grommets received on said posts, a peripheral mounting flange on said speaker for mounting said speaker to said posts, rear rubber grommets securing said peripheral mounting flange of said speaker to said mounting posts, and fasteners for securing said peripheral mounting flange to said speaker and said front and rear grommets to said posts.

4. The apparatus of claim 3 wherein the upper portion of the rear wall of said casing is inclined upwardly and away from the midsection of said rear wall to provide a viewing surface adjacent the mouth of a user in a normal use position, said inclined surface further including a first opening and a second opening; a clock/timer mounted in said housing and including a display in said first opening; and means for mounting said microphone in said second opening, said apparatus further including a foamed cover for said microphone.

5. The apparatus of claim 1 further including a battery compartment received in the upper portion of said housing, the rear surface of the upper portion of said housing providing an access door for said battery compartment; and an acoustical sheathing about said battery compartment for isolating said battery compartment from the front and side walls of said housing and for isolating the areas above and below said battery compartment.

6. The apparatus of claim 1 further comprising an electronic amplifier receiving the signal from said microphone for amplifying the same and coupling the output thereof to said speaker, said amplifier including a variable resistor for setting the amplitude of said amplifier, said resistor being actuated by a thumb wheel, said rear surface of said housing defining a laterally extending opening, said thumb wheel extending through said laterally extending opening for access by the thumb of a user for controlling the volume of said amplifier.

7. The apparatus of claim 1 wherein said casing is characterized in having a generally uniform width and, when viewed from the side, a continuously curved front wall and a back wall which extends upwardly and rearwardly from the rear of said base converging with the lower portion of said front wall to said midsection, such that the center of gravity of the casing and its contents is located above said base within a vertical extension of the periphery of said base.

8. The apparatus of claim 1 further comprising first and second loops in said rear wall of said housing adjacent said midsection thereof and spaced laterally from each other; and a flexible lanyard received in said first and second loops, whereby said lanyard may be placed around the user's neck to support said unit during non-use periods.

* * * * *